United States Patent [19]

Piesik

[11] 4,173,919

[45] Nov. 13, 1979

[54] TWO-WAY ROCKET PLENUM FOR COMBUSTION SUPPRESSION

[75] Inventor: Edward T. Piesik, Pomona, Calif.

[73] Assignee: General Dynamics Corporation, Pomona, Calif.

[21] Appl. No.: 860,038

[22] Filed: Dec. 12, 1977

[51] Int. Cl.[2] ..... F41F 3/04

[52] U.S. Cl. ..... 89/1.8; 89/1.816

[58] Field of Search ..... 244/114 B, 114 R, 63; 169/54; 89/1.8, 1.806, 1.810, 1.809, 1.812, 1.816, 1.818, 1.819, 1.703, 1.704

[56] References Cited

U.S. PATENT DOCUMENTS

| | | | |
|---|---|---|---|
| 2,445,423 | 7/1948 | Eastman | 89/1.8 X |
| 2,925,013 | 2/1960 | Santora et al. | 89/1.8 |
| 2,987,964 | 6/1961 | Logan et al. | 89/1.815 |
| 2,998,754 | 9/1961 | Bialy | 89/1.816 |
| 3,226,063 | 12/1965 | Wagner | 244/114 B |
| 3,228,294 | 1/1966 | Hickman | 89/1.8 |
| 3,228,296 | 1/1966 | Neuman et al. | 89/1.8 |
| 3,363,508 | 1/1968 | Stahmer | 244/63 X |
| 4,044,648 | 8/1977 | Piesik | 89/1.8 |

FOREIGN PATENT DOCUMENTS

| | | | |
|---|---|---|---|
| 316189 | 9/1956 | Switzerland | 89/1.816 |

*Primary Examiner*—David H. Brown

*Attorney, Agent, or Firm*—Henry M. Bissell; Edward B. Johnson

[57] ABSTRACT

A system utilizing a rocket plenum design which is of a form to reduce and control combustion therein. The plenum is provided with two oppositely and upwardly extending exhaust ducts. Provision is made to eliminate blind pockets and stagnation passages in order to prevent possible explosions in the plenum during rocket firing.

12 Claims, 4 Drawing Figures

TWO-WAY ROCKET PLENUM FOR COMBUSTION SUPPRESSION

BACKGROUND OF THE INVENTION

1. Field of the Invention

This invention relates to the field of controlled flow, exhaust manifold systems and, more particularly, to apparatus for controlling the flow of exhaust gases from a plenum chamber serving as a common exhaust manifold for a plurality of rocket launching tubes.

2. Description of the Prior Art

When a rocket is fired inside a launch tube, the exhaust gases must be discharged to some safe location. This is a particular problem when the rockets are mounted below deck in a ship or below the surface of the ground. The exhaust gases are collected and directed to discharge by use of a plenum tube or duct that is below the rocket exhaust nozzle and that controls and contains the exhaust to a safe location for discharging into the atmosphere. During a normal firing, the exhaust flows through the launch tube and into the plenum duct until the rocket is well out of the launch tube.

The rocket exhaust gases are generally rich in hydrogen and carbon monoxide. These gases will react with the available air in the plenum and cause combustion heat and possible detonation. Either will produce higher plenum pressures than are desirable.

Various known prior art patents have disclosed structure for controlling and directing rocket exhaust gases. Some of these pertain to safety doors or gas valves which are operable to admit exhaust gases into an associated manifold when a rocket is ignited. The disclosures of the Eastman U.S. Pat. No. 2,445,423 and the Neuman et al U.S. Pat. No. 3,228,296, for example, illustrate the use of such doors or valves, as does also the Piesik U.S. Pat. No. 4,044,648. Eastman also discloses a large open-ended exhaust manifold for rockets stored otherwise than in a launch tube to permit the safe detonation of such a rocket by greatly reducing the exhaust pressure in the large manifold. Balancing of exhaust reaction forces is achieved by releasing gases simultaneously in opposite directions. Structures for directing or diffusing rocket or missile exhaust gases safely or, in one instance, for suppressing the noise of reaction engines are disclosed in the Santora et al U.S. Pat. Nos. 2,925,013, the Logan et al U.S. Pat. No. 2,987,964, the Shearer U.S. Pat. No. 3,159,238 and the Hickman U.S. Pat. No. 3,228,294. However, none of these prior art patents is found to deal with the problem here involved, at least in the manner disclosed herein in connection with the present invention.

SUMMARY OF THE INVENTION

In brief, arrangements in accordance with the present invention provide a common plenum chamber for a plurality of rockets and a pair of upstanding exhaust ducts connected to the plenum chamber via smoothly curved elbows. The exhaust ducts are located at opposite ends of the plenum chamber and at opposite ends of the row of rocket launch tubes, which may be aligned next to each other in a straight line or may be spatially positioned along a curved plenum chamber.

Each of the launch tubes, where it connects with the plenum chamber, is provided with a protective seal. This seal is preferably a retractable door mechanism and may be controlled to insure that the door mechanism is closed at all times except when the rocket in the associated launcher tube is firing. This arrangement serves to prevent the escape of hot exhaust gases from another rocket past a rocket which is stored in a launch tube—a highly dangerous situation—or through a launch tube from which the rocket has been previously fired, again an undesirable situation. When closed, the doors block off the launch tube so that the tube cannot serve as a blind pocket of air with which the exhaust gases from another rocket might mix and form an explosive combination.

As a beneficial result of the use of structure embodying the present invention, the exhaust gases which are driven into the plenum chamber when a particular rocket is first ignited mix with the available air and develop a further burning in the immediate vicinity of the gas which is first exhausted by virtue of the previously uncombusted hydrogen and carbon-monoxide reacting with the available oxygen. However, as the exhaust gas continues to be driven into the plenum chamber from the launch tube in which a rocket is being fired, two fronts or gas barriers are formed, one on each side of the firing rocket. These fronts consist of the exhaust gas which was first emitted by the rocket into the plenum chamber and which very quickly mixed with the available air and burned further to a point where the mixture could no longer support combustion. These fronts now maintain a separation between the exhaust gases continuing to be driven into the plenum chamber by the firing rocket and the air remaining in the plenum chamber and duct system. As these fronts are driven away from the launch tube containing the firing rocket by the additional exhaust gases being emitted therefrom, they drive the remaining air in the system out of the plenum chamber and out of the termination ducts at the ends thereof, all the while maintaining the separation between the air and the combustion-rich exhaust gases which are later emitted. Once the air is driven out of the plenum chamber and duct system, there is no longer any danger of detonation within the the system due to reaction of the unburned hydrogen and other combustible products in the exhaust gases.

The particular configuration of the structure comprising the plenum and exhaust ducts is not considered critical; however, certain design factors should be taken into consideration. Although not necessarily round in cross-section, all corners or elbows are curved sections with generous radii to allow the exhaust to flow undisturbed toward the outlet ends of the upwardly directed exhaust ducts. Angled corners and pockets are to be avoided wherever possible. The total exhaust duct cross-sectional area should be relatively small. This area is dependent upon the maximum expected exhaust flow rate, considering that the exhaust will be divided more or less equally between the two exhaust ducts. Since it is desirable to maintain a relatively low plenum pressure of about 15% over outside ambient pressure, the cross-sectional area should be sized for about a Mach 0.5 velocity at steady state conditions. Discontinuities in the constant area ducts should be kept to a minimum, since any stagnant volume is a potential pocket for a combustible mixture to accumulate.

It is preferable to maintain the exhaust duct cross-sectional area essentially constant, or at least to provide that the area increases slightly with distance from the plenum chamber proper. If the flow area becomes significantly less with distance, the plenum tends to act as an accumulator and much more mixing of the fuel-rich exhaust and air will occur near the rocket. If the flow area increases too rapidly with distance, then volumetric efficiency is lost. If a structure is selected which provides an increase in cross-sectional area of the exhaust ducts with distance, then the enlargement should occur beyond the last of the rockets in a row so that the air in the plenum chamber proper may be cleared out before substantial mixing with the exhaust gases can occur. The shape of the cross-section may also be varied to accommodate certain space requirements or other limitations if the considerations discussed herein with respect to the cross-sectional area are observed.

The primary concern is to prevent a large volume plenum of relatively stagnant, turbulently mixed, fuel-rich exhaust and available air from developing within a region having a restricted outlet for these mixed plenum gases. If such a situation is not prevented, the resulting mixture would be likely to combust and/or detonate with a resultant sharp increase in pressure. The pressure due to combustion heat input can be several orders of magnitude above the steady state pressure without combustion. Detonation pressures are some 5 to 18 atmospheres and may be even higher.

In one particular structural configuration in accordance with the present invention, a plurality (two or more) of rockets and rocket launch tubes are spatially disposed in a line above a generally horizontal, associated tubular plenum chamber which extends the full length of the line. At opposite ends of the plenum chamber are a pair of upstanding exhaust ducts joined to the plenum chamber by respective gently and continuously curved elbows. The cross-sectional area of each exhaust duct approximates that of the plenum chamber itself, at least in the vicinity of the region where the exhaust duct and plenum chamber are joined together. In one variation of the invention, the walls of the exhaust duct are tapered slightly so that the cross-sectional area increases gradually from the inlet end which is coupled to the plenum chamber to the outlet end remote therefrom.

In another particular arrangement in accordance with the present invention, the respective rocket launch tubes are arrayed relative to each other to form a general horseshoe configuration. The plenum chamber extends as a continuous horseshoe-shaped manifold underneath all of the launch tubes. The plenum chamber further extends beyond the horseshoe-shaped layout of the rocket launch tubes to the respective positions of the two upwardly-directed exhaust ducts, one at each end of the horseshoe. As with the in-line arrangement of the rocket launch tubes and plenum-duct exhaust system described hereinabove, the exhaust from any one rocket in the horseshoe will divide more or less equally and progess toward the two exhaust ducts at opposite ends, developing the two gas barriers or fronts previously described and driving the rest of the air in the system in front of the barriers and out the respective ducts.

During the transition period after a rocket in any one of the launch tubes begins firing and before the air is driven out of the system, there are three gas phases within the system: (1) the air which is being driven out, (2) the combustion products resulting from the reaction of the fuel-rich exhaust gases and the adjacent air to form the gas barriers, and (3) the raw exhaust still issuing from the rocket and acting to drive the barriers or fronts outwardly through the system away from the vicinity of the firing rocket, pushing the rest of the air out of the plenum and exhaust ducts ahead of them.

With most rockets firing in a system in accordance with the present invention, this first transition period is completed in a very short time, possibly as short as 10 to 100 milliseconds. However, it is during this brief period that the problem to which the present invention is directed exists and, without protection against it as is provided by arrangements in accordance with the present invention, the initial raw exhaust gases mixing in an otherwise open plenum or accumulating in stagnation pockets and chambers may cause a dangerous explosion.

BRIEF DESCRIPTION OF THE DRAWING

A better understanding of the present invention may be had from a consideration of the following detailed description, taken in conjunction with the accompanying drawing in which.

DESCRIPTION OF THE PREFERRED EMBODIMENTS

Figure 1:
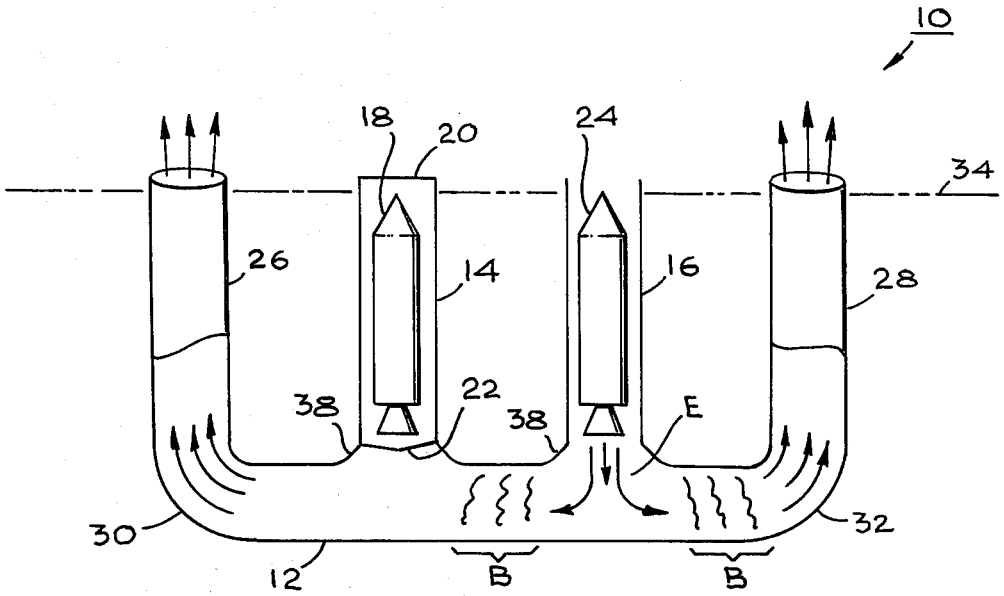
FIG. 1 is an elevational view of a particular arrangement in accordance with the invention.

In FIG. 1, a system 10 in accordance with the invention is shown in schematic elevation as comprising a plenum chamber 12 positioned underneath and connected to a pair of rocket launch tubes 14 and 16. The launch tube 14 contains a rocket 18 in storage condition, the launch tube 14 being closed at its upper end by a cap 20 and sealed off at its lower end from the plenum chamber 12 by a protective seal 22. The seal 22 may very well comprise a door mechanism such as is disclosed in my aforementioned U.S. Pat. No. 4,044,648.

Within the launch tube 16 is shown a rocket 24. The rocket 24 is firing, presumably in the initial phase of a launch operation, and its exhaust is directed downwardly and into the plenum chamber 12. The seal such as 22 at the lower end of the launch tube 16 is open, and the cover, such as 20, at the upper end of the launch tube 16 is removed.

Figure 2:
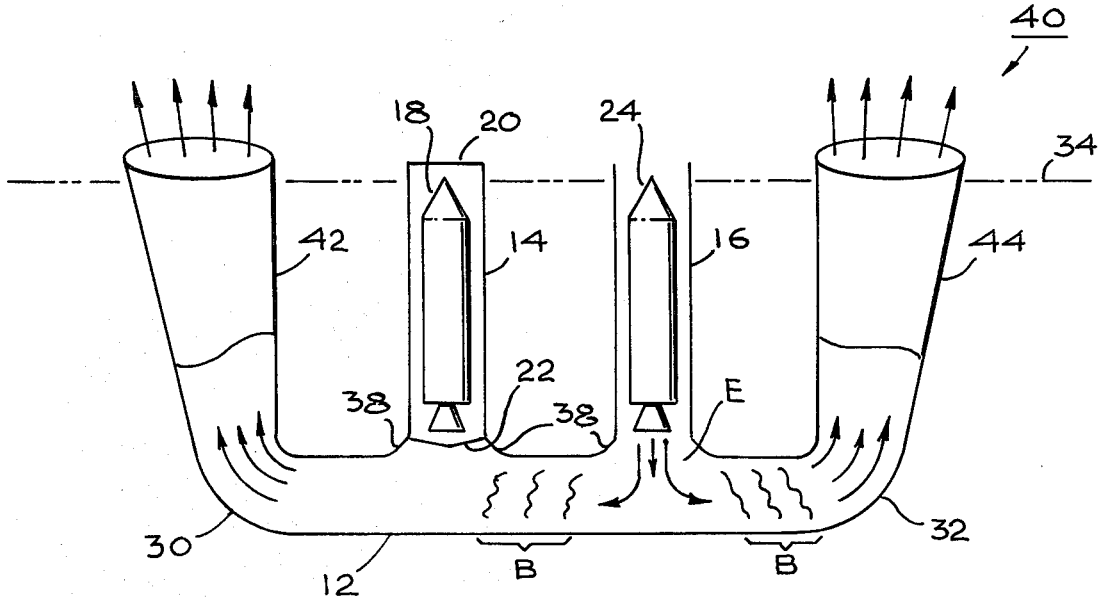
FIG. 2 is an elevational view of another particular arrangement in accordance with the present invention.

A pair of upstanding exhaust ducts 26 and 28 are connected to the plenum chamber 12 at the left-hand and right-hand ends thereof, respectively, via elbows or curved tubes 30 and 32. The system 10 as depicted is designed for installation on board ship or underground and a deck level is indicated by the broken line 34. The configuration of the plenum chamber 12 and exhaust ducts 26, 28 is arranged to provide a smoothly continuous interior surface with minimum discontinuities. To this end, the elbows 30 and 32 are of constant radius. Where discontinuities are unavoidable, as at the base of the launch tubes 14, 16, the chambers formed thereby are maintained as shallow as possible by having the seals 22 of a closed launch tube as close to the juncture of the launch tube with the plenum chamber as is feasible, and by having the corner 38 at such juncture angled, flared, or otherwise faired into the wall of the plenum chamber 12. As shown in FIGS. 1 and 2, the corners 38 are smoothly curved at the junctures with the plenum chamber 12. In this manner, stagnation pockets which might accumulate a combustible mixture of raw exhaust gas and air are avoided and eliminated.

The rocket exhaust, designated E, is shown entering the plenum 12 from the rocket 24 of launch tube 16. As shown in FIGS. 1 and 2, the rocket 24 has just initiated firing. The gas barriers or fronts, designated B, are shown forming on either side of the exhaust E and beginning to drive the air (indicated by the arrows) ahead of them out of the plenum 12 and associated exhaust ducts 26, 28 as the exhaust gases E spread in both lateral directions from the immediate vicinity of the rocket 24.

FIG. 2 is a similar schematic elevation showing an alternative arrangement 40 to that depicted in FIG. 1. Where the same components are employed, they are designated by the same reference numerals. Thus, the system 40 of FIG. 2, as shown, is identical to that of FIG. 1 in the rocket and launch tube arrangement and associated plenum chamber 12. The system 40 differs from that of FIG. 1 in that exhaust ducts 42 and 44, connected respectively to left-hand and right-hand ends of the plenum 12 by the elbows 30 and 32, are tapered slightly so that the cross-sectional area of the exhaust ducts 40, 42 increases gradually with distance from the elbows 30, 32. As shown in FIG. 2, the exhaust ducts 42, 44 are identical to each other in configuration and dimension, although this is not essential. For example, one of these flared exhaust ducts, such as 42, might be combined with one of the constant area exhaust ducts, such as 28, of FIG. 1. It is important, however, that there not be a significant reduction of cross-sectional area along the length of the exhaust duct for the reasons already discussed.

Figure 3:
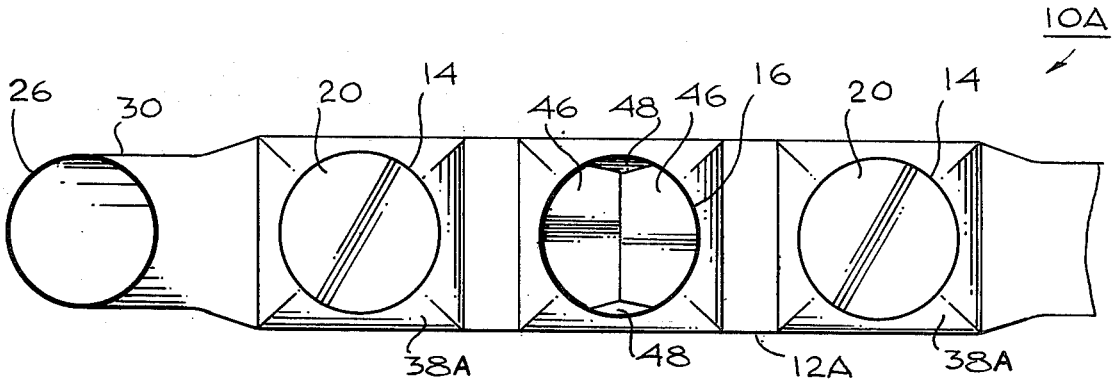
FIG. 3 is a plan view of an arrangement in accordance with the present invention showing certain details of the rocket launch tubes.

FIG. 3 is a plan view of a system 10A in accordance with the invention. This is essentially similar to the system 10 of FIG. 1, except that three rocket launch tubes 14, 16, are shown instead of two. Corner portions 38A join the launch tubes to the plenum chamber with shallow angles, thus avoiding the development of any stagnation pockets in these regions. In the two launch tubes 14 of FIG. 3, the covers 20 are in place. However, in the center launch tube 16, the cover is removed, as well as the rocket normally stored therein, and the elements visible within the launch tube 16 are a pair of doors 46 at the bottom of the launch tube together with side portions 48 with which the doors 46 mate in sealing relationship when closed. A more detailed description of this structure is set forth in my aforementioned U.S. Pat. No. 4,044,648. The combination of the doors 46 and side portions 48 comprises one particular embodiment of the seal structure 22 shown in FIGS. 1 and 2.

Figure 4:
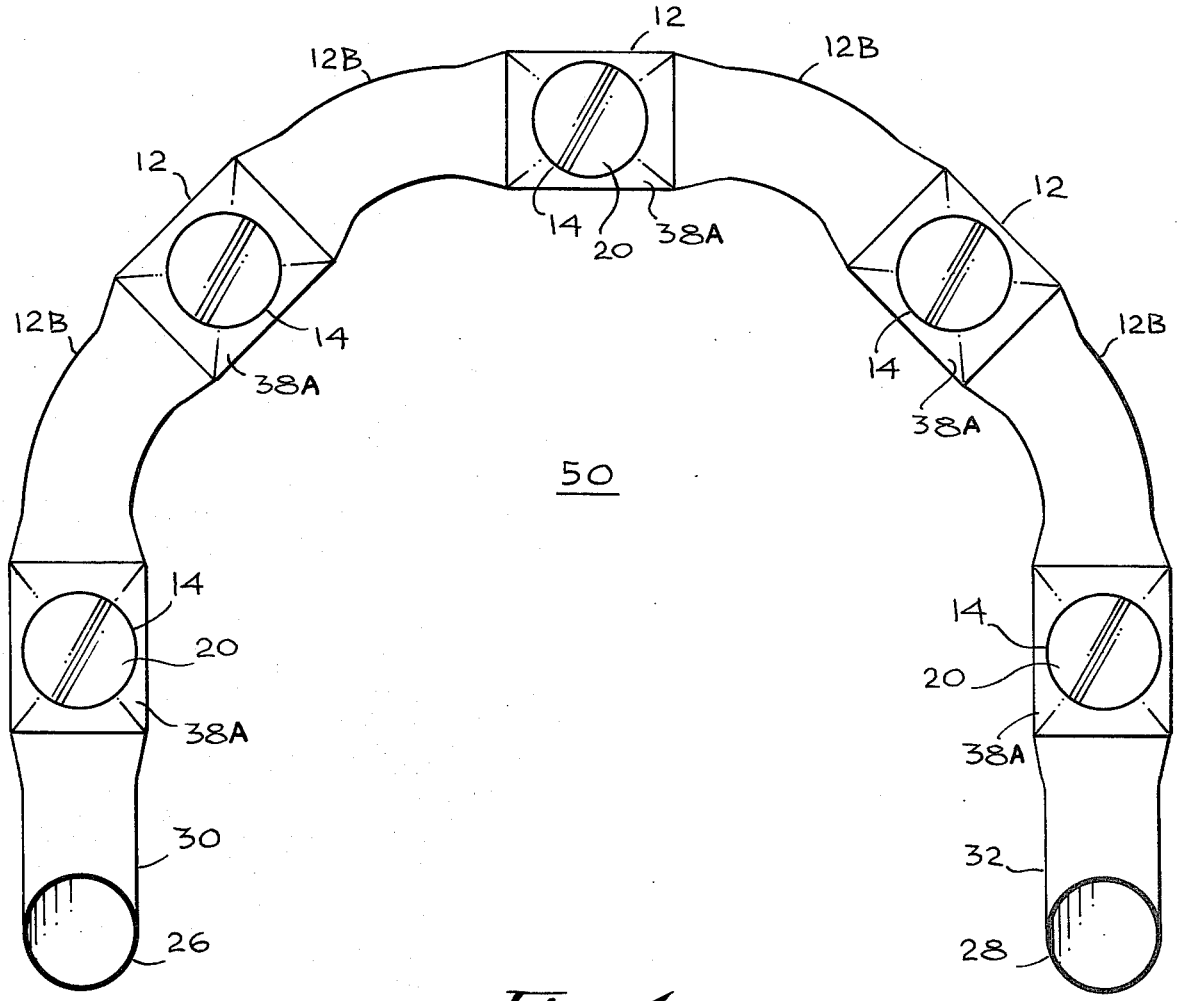
FIG. 4 is a plan view of still another arrangement in accordance with the invention.

FIG. 4 illustrates in plan view another particular arrangement in accordance with the present invention showing a plurality of launch tubes 14 similar to those shown in FIG. 3. In FIG. 4, a system 50 is shown comprising a greater plurality (in this case, five) of rocket launch tubes 14 arrayed in a horseshoe-shaped layout which is more compact that the in-line layouts of FIGS. 1–3 for the same number of launch tubes. In FIG. 4, similar elements have been designated by the same reference numerals as in the preceding figures. Individual portions of the plenum chamber 12 under corresponding launch tubes 14 are connected by curved plenum portions 12B in a smoothly continuous curve.

Operation of the system 50 is essentially the same as that described for the systems of FIGS. 1 and 2. Thus, when a given rocket is fired, for example that in the launch tube nearest the left-hand exhaust duct 26, the exhaust divides on entering the plenum chamber 12, developing the gas barriers or fronts as before which are driven respectively toward the left-hand exhaust duct 26 and right-hand exhaust duct 28. Because the respective distances from such a launch tube 14 to the exhaust ducts are different, it may be expected that the gas barrier from one side will reach the nearest exhaust duct before the other gas barrier reaches the other exhaust duct. Moreover, because of the differences in distance, the respective back pressures may be slightly different. However, the differences are not such as to cause any significant difference in the operation as described or in the effectiveness of the gas barriers in clearing the respective plenum and exhaust duct passages of the air initially present therein, thus preventing mixing of the bulk of the air with the exhaust gases to develop a possibly explosive mixture.

Although there have been described above specific arrangements of two-way rocket plenums and associated exhaust duct systems for combustion suppression in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the appended claims.

What is claimed is:

1. A rocket plenum exhaust system for suppressing unwanted combustion of raw exhaust gases within a manifold comprising:

a plurality of rocket launch tubes positioned in line adjacent one another;

a continuous plenum chamber extending generally horizontally along the line of launch tubes and having means for connecting to each of the launch tubes at the base thereof;

means for releasably sealing each launch tube adjacent the base thereof from communication with the plenum chamber, said sealing means being adapted to open upon the firing of a rocket in the associated launch tube to admit exhaust gases from the rocket into the plenum chamber upon said firing and to close for sealing off the launch tube under all other circumstances; and a pair of upstanding exhaust ducts coupled respectively to opposite ends of the plenum chamber and being sized to correspond approximately in cross-sectional area to the cross-sectional area of the plenum chamber.

2. The system of claim 1 wherein each of the ducts is of substantially constant cross-sectional area throughout its length.

3. The system of claim 1 wherein the plenum chamber and exhaust duct interior surfaces are smoothly continuous to eliminate the occurrence of pockets or stagnation passages in which an explosive mixture of exhaust gases and air may accumulate.

4. The system of claim 1 wherein the launch tubes, plenum chamber and exhaust ducts are mounted substantially below the deck of a ship, the launch tubes and exhaust ducts having openings extending upwardly through the deck.

5. The system of claim 1 further comprising means for fairing the base of each launch tube into the plenum chamber at the juncture thereof to minimize the development of stagnation pockets for the accumulation of an explosive mixture of exhaust gases and air subject to detonation within the system.

6. The system of claim 1 wherein the plenum is provided with a cross-sectional area selected to develop an exhaust gas flow velocity of about Mach 0.5 for steady state conditions during launching of a rocket from an associated launch tube.

7. The system of claim 1 further comprising means for coupling the lower ends of the exhaust ducts to the corresponding ends of the plenum chamber in a smoothly continuous arrangement.

8. The system of claim 7 wherein the coupling means comprise a pair of smoothly continuous elbows, one for each exhaust duct, coupling the associated exhaust duct to a corresponding end of the plenum chamber.

9. The system of claim 8 wherein each elbow is of substantially constant radius and extends through an angle of approximately 90°.

10. The system of claim 1 wherein the exhaust ducts are of cross-sectional area throughout their extent not less than the minimum cross-sectional area of the plenum chamber.

11. The system of claim 10 wherein at least one of the exhaust ducts is of varying cross-sectional area which increases with distance from its inlet end adjacent the plenum chamber to its outlet end remote therefrom.

12. The system of claim 11 wherein both of said exhaust ducts are of like configuration with increasing cross-sectional area from inlet to outlet end.

* * * * *